United States Patent [19]

Babitzka

[11] Patent Number: 5,007,400

[45] Date of Patent: Apr. 16, 1991

[54] HYDRAULIC CONTROL DEVICE FOR FUEL INJECTION SYSTEMS OF INTERNAL COMBUSTION ENGINES

[75] Inventor: Rudolf Babitzka, Kirchberg-Neuhof, Fed. Rep. of Germany

[73] Assignee: Robert Bosch GmbH, Stuttgart, Fed. Rep. of Germany

[21] Appl. No.: 328,396

[22] Filed: Mar. 24, 1989

[30] Foreign Application Priority Data

Jun. 11, 1988 [DE] Fed. Rep. of Germany ..... 3819996

[51] Int. Cl.[5] ..... F02M 37/04

[52] U.S. Cl. ..... 123/506; 123/449; 123/503

[58] Field of Search ..... 123/506, 458, 449, 500, 123/501, 503

[56] References Cited

U.S. PATENT DOCUMENTS

| | | | |
|---|---|---|---|
| 4,395,987 | 8/1983 | Kobayashi | 123/506 |
| 4,480,619 | 11/1984 | Igashira | 123/458 |
| 4,546,749 | 10/1985 | Isgashira | 123/506 |
| 4,630,588 | 12/1986 | Sagawa | 123/506 |
| 4,665,875 | 5/1987 | Lakin | 123/506 |
| 4,753,212 | 6/1988 | Miyaki | 123/506 |
| 4,779,599 | 10/1988 | Phillips | 123/506 |
| 4,782,803 | 11/1988 | Kikuchi | 123/506 |
| 4,793,315 | 12/1988 | Phillips | 123/506 |

*Primary Examiner*—Carl S. Miller
*Attorney, Agent, or Firm*—Edwin E. Greigg

[57] ABSTRACT

A hydraulic control device for fuel injection pumps of internal combustion engines, having a control conduit that branches off from a high-pressure chamber, such as a pump work chamber, and acts in a control chamber upon a control face of a stepped piston for hydraulically stepping down the volume, the piston working face having the smaller diameter defining a closed work chamber, which has an outflow controllable by a valve; a functional face on the movable valve element is acted upon from the work chamber and determines the time/-cross section control.

17 Claims, 1 Drawing Sheet

HYDRAULIC CONTROL DEVICE FOR FUEL INJECTION SYSTEMS OF INTERNAL COMBUSTION ENGINES

BACKGROUND OF THE INVENTION

The invention is based on a hydraulic control device as defined hereinafter. In hydraulic control devices that operate with closed fluid-filled chambers and in which pistons and valve faces are acted upon, the basic relationship between the fluid-impinged surface area and the forces derivable from the fluid pressures and surface areas always presents problems when the time factor plays a role. The same force for instance can be attained with a low pressure and a large surface area or conversely with a high pressure and a small surface area; but for the time factor, it is the control of the volume or in other words the quantity flowing out per unit of time that is definitive. The valves used for control should have an extremely short opening and closing time factor, on the one hand, and on the other should have as little flow resistance, or in other words as small a control cross section, as possible. A hydraulic control device of this kind becomes problematic if large volumes of fluid at high pressure must be controlled at very short time intervals, as is the case for instance with fuel injection, when the control must be effected in less than a millisecond and must vary with the rpm.

In a known fuel injection pump (German Offenlegungsschrift 29 25 418.0), the fuel injection can be interrupted by relieving the pressure of the pump work chamber via a relief conduit; this conduit is controlled via a magnetic valve. The movable valve element of the magnetic valve is acted upon directly by the high pressure of the pump work chamber, so when the valve is closed, if no outflow is to take place, then depending on the functional surface area operative in the opening direction of the movable valve element, considerable forces must be brought to bear to keep the valve closed. With a magnetic valve that is open when there is no current through it, which for safety reasons is the kind of valve usually used for this purpose, the energy consumption of the magnet is proportional to the forces required to keep the valve closed. To obtain the opening time cross section, which is a product of the opening time and the opening cross section, that is required for control, a relatively large cross section must usually be selected, given the short times that are available; this means large, expensive magnets and a correspondingly high consumption of electricity.

In another known fuel injection pump (German Offenlegungsschrift 36 22 627), a pressure line branches off from the pump work chamber, and the fuel is supplied via this line to a deflecting piston, which is displaced by the feed pressure of the injection pump whenever the magnetic valve is open; the space on the back side of the deflecting piston is pressure-relieved by the magnetic valve. This piston is loaded by a restoring spring, which piston injects this fuel received as it deflects into the combustion chamber of the engine via the injection nozzle toward the end of the injection and after the end of the high-pressure feeding. The result is a longer injection duration and quieter engine idling. In this pump, once again, the movable valve element of the magnetic valve is virtually at the feed pressure of the injection pump, because this very high pressure is lessened only by the force of the restoring spring. In other words, once again high closing forces must be brought to bear, entailing correspondingly high cost and requiring a large amount of space and energy.

This is in principle also true if a mechanically actuated adjuster is used, instead of a movable valve element of a magnetic valve.

OBJECT AND SUMMARY OF THE INVENTION

The hydraulic control according to the invention has an advantage over the prior art that the fluid volume that must flow through the valve within a predetermined period of time for a predetermined displacement of the control piston is reduced, by comparison with the volume that is aspirated and pre-stored in the control piston when it moves, by the ratio of the size of the working face with that of the control face. This means that if the control face is twice as large as the working face, then the volume that must flow through the valve is precisely one-half as large as the volume flowing on to the control face. However, the pressure in the work chamber increases inversely proportionally to the control chamber pressure; that is, the pressure in the work chamber is greater, by the ratio of the control face to the working face, than in the control chamber. This pressure in the work chamber in turn acts upon the movable valve element of the valve, so that their closing pressures must be adapted to that pressure. Because of the ratio of the surface area of the working face and the control face, which is greatly diminished by the volume to be controlled by the valve, the opening cross section of the valve can be decreased accordingly as well; it now proves, advantageously, that if the closing force remains unchanged, the use of the stepped piston makes it possible to attain a time/cross section gain corresponding to the surface area ratios. The advantage can also be described in this way: Because of the reduction in the volume to be controlled, despite the resultant pressure increase, with the closing force of the movable valve element remaining unchanged, there is a time/opening cross section gain corresponding to the surface area ratio; or again, with the expenditure of closing force at the valve remaining unchanged, a faster stroke of the control piston is attainable, or conversely, for a predetermined speed of the control piston, a smaller opening cross section at the valve is attainable with the invention.

This advantage is particularly effective in fuel injection pumps for internal combustion engines in which the duty cycles are extremely short - as in a four-cylinder engine at 4000 rpm, which is equivalent to approximately 66 duty cycles of the deflecting piston per second; moreover, this varies as a function of the rpm.

In an advantageous embodiment of the invention, a magnetic valve is used as the control valve, so that the smaller adjusting forces required as a result of the invention are particularly advantageous, because the expense for generating a magnetic force increases not only with the structural volume but also in terms of cost in proportion to the magnitude of the adjusting force.

In a further feature of the invention, the stepped piston is spring-loaded in the direction of the pump work chamber, so that after the reduction of the pressure in the pump work chamber it is automatically thrust back into an outset position.

According to the invention, the stepped piston may be used as a deflecting piston or for controlling a relief conduit. In the first case, the control piston functioning as a deflecting piston is displaced counter to the restoring force by the pressure in the pump work chamber as soon as the valve opens; in this process, a volume is stored in front of its control face that is then pumped back again by the control piston toward the end of the injection. Once again, two variants are conceivable: Either this return pumping leads directly via the injection valve to injection, or this stored quantity is supplemented for the injection by the injection pump governor. In either case, this device attains a prolongation of the injection duration, which is particularly significant in idling, so as to attain smooth engine operation as a result. In the second case, in which the control piston controls the passage through the relief conduit, the small control valve according to the invention controls a large outflow cross section at the control piston.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
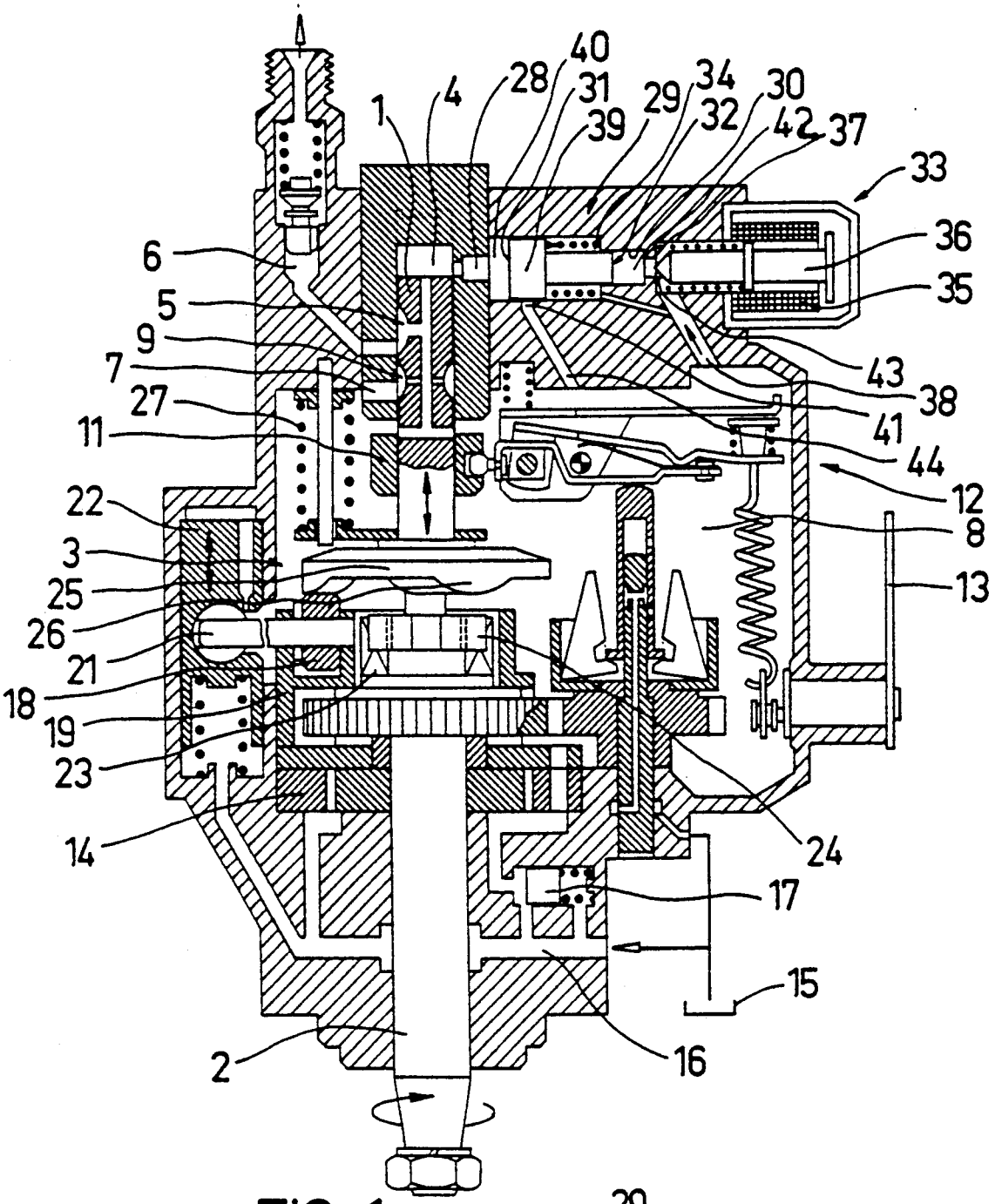
FIG. 1 shows a distributor injection pump in longitudinal section, having the stepped piston as a pre-controlled valve.

In the distributor injection pump shown in longitudinal section in FIG. 1, a pump piston 1 also serving as a distributor is set into simultaneously reciprocating and rotary motion by a drive shaft 2 with the aid of a cam drive 3. Upon each compression stroke of the pump piston 1, fuel is pumped out of a pump work chamber 4 via a longitudinal distributor groove 5 to one of a plurality of pressure conduits 6, which are distributed at equal angular intervals about the pump piston 1, each leading to one combustion chamber, not shown, of an internal combustion engine.

The pump work chamber 4 is supplied with fuel via a suction conduit 7 from a fuel-filled suction chamber 8 located in the housing of the fuel injection pump, in that during the intake stroke of the pump piston 1, the suction conduit 7 is opened up by means of longitudinal control grooves 9 provided in the pump piston 1. The number of control grooves 9 is equivalent to the number of pressure conduits 6 and hence to the number of compression strokes executed per rotation of the pump piston.

The quantity to be injected, which is pumped per stroke into each of the pressure conduits 6, is determined by the axial position of a governor slide 11 disposed surrounding the pump piston 1. This axial position is determined by an rpm governor 12 and an arbitrarily actuatable adjusting lever 13, taking into account the rpm and load at the time (the load may for instance correspond to the position of the gas pedal of the motor vehicle).

The suction chamber 8 is supplied with fuel from a feed pump 14, which is driven by the drive shaft 2 and is supplied with fuel from a fuel tank 15 and a suction line 16. By means of a pressure control valve 17, the outset pressure of the feed pump 14 and hence the pressure in the suction chamber 8 are controlled; this pressure increases with increasing rpm in accordance with a desired function. Because both the cam drive 3 and the rpm governor 12 are disposed in the suction chamber 8, they are exposed to this pressure on all sides and are also lubricated on all sides by this fuel.

The cam drive 3 has a roller ring 19 with rollers 18, which is supported in the housing such as to be rotatable about a certain angle; the rollers 18 are supported in the U-shaped cross section of roller ring 19. The roller ring 19 is coupled in a manner fixed against relative rotation with an injection adjuster piston 22 via an adjusting bolt 21. This injection adjuster piston 22 is shown rotated by 90° in the drawing; that is, it operates at right angles to the plane of the drawing. A claw coupling is provided in the internal bore of this roller ring 19; claws 23 of the drive shaft 2 located on the drive side mesh with claws 24 of the pump and distributor piston 1 on the power takeoff side, so that the pump and distributor piston 1 can execute a reciprocating motion during its rotation, independently of the drive shaft 2. A face cam disk 25 is disposed on the pump piston 1, which with its face having face cams 26 rolls on the rollers 18; the number of face cams corresponds to the number of pressure conduits 6. The cam race of the face cam disk 25 is pressed by springs 27, only one of which is shown, against the rollers 18.

A high-pressure control line 28 branches off from the pump work chamber 4 and leads to a control piston 29, which is stepped and is axially displaceably guided in a corresponding stepped bore 30; the end face of the piston 29 having the larger diameter, here identified as the control face 31, is oriented toward the pump work chamber 4. Contrarily, the second end face of the piston, having the smaller diameter and in this case identified as the working face 32, defines a segment of the stepped bore 30, which is closed by a magnetic valve 33 and the area defined by the small end of the piston and the stepped bore is identified as the work chamber 42. The control piston 29 is also urged in the direction of a control chamber 40 by a spring 34 which control chamber is defined by the end face 31 and the large end of the stepped bore.

In the first exemplary embodiment, shown in FIG. 1, the magnetic valve 33 is constructed such that it is open when there is no electricity applied to the coil 35. As soon as the valve 37 opens and the spring 34 forces the control piston 29 to the left, fuel at the pressure of the suction chamber 8 is admitted to the work chamber 42 via the conduit 38. As soon as the magnet coil 35 of this magnetic valve 33 is excited, the movable valve element 36 of the magnetic valve is forced onto the valve seat 37 and the work chamber 42 is closed. The functional face 43 of the movable valve element 36 that is thereafter acted upon from the work chamber and operates in the opening direction is smaller than the working face 32 of control piston 29 and determines the maximum opening cross section of the magnetic valve 33.

As soon as the magnetic coil 35 is electrically switched off, the high pressure prevailing in the pump work chamber 4 and propagated to the control chamber 40 displaces the control piston 29 to the right; the fuel stored in front of the working face 32 in the work chamber 42 is positively displaced past the valve seat 37 through a relief conduit 38 to the suction chamber 8. Although the fuel pressure in the work chamber 42 is correspondingly higher than in the control chamber 40, because of the stepped ratio of the control face to the working face, one magnetic valve 33 with a relatively small functional face 42 or a comparatively small valve seat 37 suffices, because, as a function of the surface area ratio at the control piston 29, for a particular control piston stroke to be controlled, only a relatively small quantity needs to flow out of the work chamber 42 via the valve seat 37, depending on a desired volume stored in front of the control face 31 or in other words corresponding to a relatively large quantity.

In the exemplary embodiment of FIG. 1, the control face 31 of the control piston 29 having the larger diameter, oriented toward the piston 39, controls an entrance 41 of a second relief conduit 44, so that after the reciprocation of the control piston 29 to the right, the pump work chamber 4 is relieved of pressure in favor of the suction chamber 8. As a consequence, no pressure can build up in the pump work chamber, and the engine stops.

Figure 2:
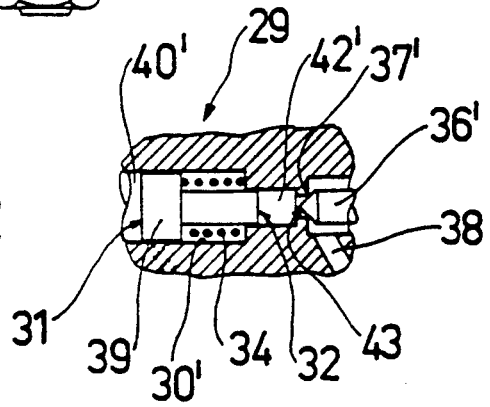
FIG. 2, on a larger scale, shows a detail pertaining to the invention of the distributor pump of FIG. 1, with the stepped piston functioning as a deflecting piston.

In principle, the second exemplary embodiment of the invention, shown in FIG. 2, is similar in design to the first, but with the distinction that the control piston 29 here functions as a deflecting piston, and the magnetic valve 33 is closed when it is without current. As soon as the magnet coil 35 of the magnetic valve 33 is excited, the movable valve element 36 lifts from the valve seat 37', and the fuel under pressure in the pump work chamber displaces the control piston 29 toward the right, whereupon the working face of the control piston 32 positively displaces fuel out of the work chamber 42' and through the relief conduit 38 to the pump suction chamber. This fuel volume, collected in the manner of a reservoir in front of the control face 31, is then, after the end of the high-pressure phase in the pump work chamber 4, while the pump piston 1 is at rest or in the ensuing intake stroke, is pumped back into the pump work chamber 4 or is pumped via it and one of the pressure channels 6 to the engine, where it is injected. This quantity can also be supplemented at the pump by the governor. This method of temporarily storing a certain quantity of fuel during the injection is known as the quiet-idle method, because it prolongs the injection duration and thus makes quiet idling of the engine attainable.

By means of the invention, it is attained that this temporary storage is attainable with the aid of a standard magnetic valve 33, because of the use of the control piston 29 according to the invention. For a desired adjusting speed of the control piston 29, the step-down in the volume in front of the control face 31 in the control chamber 40' by comparison with the volume in front of the working face 32 in the work chamber 42 dictates a predetermined minimum opening cross section at the magnetic valve 33, which is defined by the functional face 43. That is, although because of the stepdown ratio this volume in the work chamber 42' to be controlled by the magnetic valve 33 is only half as large as the original volume in the control chamber 40', the outflow cross section of the work chamber or the functional face 43 of the magnetic valve can be reduced accordingly, so as also to reduce the closing forces engaging the valve element, which are based on the pressure in the work chamber 42'. As a result, depending on the step-down ratio, a gain in the direction of the opening time cross section is attainable, or in other words a higher adjusting speed of the control piston is attainable than with the known systems without stepped pistons.

The invention will be more clearly understood from the following numerical example.

The assumed dimensions are as follows:

| Stepped piston |
|---|
| control face 31, D = 4 mm |
| working face 32, d = 2 mm |
| opening stroke, h = 0.4 mm. |

The high pressure (pump) is assumed to be R = 100 bar, which is exerted upon the control face 31;

$$A=\pi\cdot D^2/4=\pi\cdot 16/4.$$

Because of the ratio D/d, a pressure upon the working face 32 of 4 . p = 400 bar results in the work chamber 42.

If the valve seat 37 also has a diameter of 2 mm, for example, the retension force on the magnetic valve 33/36 would be $F=A\ 4p/4=125$ N.

The opening cross section $D\cdot\pi\cdot h/2 = 4\cdot\pi\cdot 0.4/2\approx 2.5$ mm$^2$.

Without the stepped piston, the opening cross section would be:

$$D\cdot\pi\cdot h=4\cdot\pi\cdot 0.4\approx 5\ \text{mm}^2.$$

Since the pressure in the work chamber is increased by a factor of 4, however, a correspondingly higher pumping rate of the positively displaced volume results, which is $\pi\cdot D^2\cdot x/4$, where x is assumed to be 3 mm.

Thus only $(D/2)^2\cdot\pi\cdot x/4=V/4=12.5$ mm$^3$ needs to be displaced from the work chamber, in order to gain 50 mm$^3$ of volume in the control chamber.

The relationship is accordingly this: 5 mm$^2$ of outflow cross section for 50 mm$^3$ of control chamber volume, which with the stepped piston is attainable at only 2.5 mm$^2$. A further advantage is that of the higher outflow speed v. Since the is equivalent to p/f, an advantage arises at v = 4p/f that is, a factor 2, or in other words twice the outflow speed.

Naturally influence can also be exerted by reducing the seat diameter and/or varying the opening stroke, in each case with a corresponding effect on the parameters.

Since substantially lesser adjusting forces are required despite the higher pressure in the work chamber 42 and hence in front of the movable valve element 36, better mastery of the control is also obtained.

All the characteristics described above, shown in the drawings and recited in the following claims may be essential to the invention, either singly or in any arbitrary combination with one another.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A hydraulic control for fuel injection systems of internal combustion engines; comprising, a piston cylinder;

a pump piston in said piston cylinder, a pump piston work chamber (4) formed by said pump piston and said piston cylinder;

a stepped control piston (29) having a large diameter end (39) having a first control face (31) and a smaller diameter end having a smaller second control face (32) guided axially displaceably and radially sealingly in a corresponding stepped housing bore (30) forming a control chamber (40) and a closable work chamber (42), said first control face (31), can be acted upon by fluid from said piston work chamber present in said control chamber (40) against a pressure acting on said second control face in said closable work chamber (42) defined by said housing bore (30) and by said second control face (32) embodied by said smaller diameter face end (32) of the control piston (29) remote from the larger diameter first control face (31); a rear side of said larger diameter end of said stepped control piston being subjected to a fluid therein and a biasing force, a controllable outflow relief conduit (38) extending from said closable work chamber (42) to a fluid-filled suction chamber (8); said controllable outflow conduit including a valve seat (37) with a predetermined maximum opening cross-section;

a control valve (33) operative relative to said valve seat (37) for a fuel flow control between said closable work chamber and said suction chamber, said control valve thereby controlling a movement of said control piston under action of fuel pressure in said control chamber and thereby controlling a take-off fuel quantity out of the pump work chamber via a relief conduit (44);

said control valve (33) having a movable valve element when closed having an end with a functional face (43) exposed to a pressure in said closable work chamber (42), said pressure acting in the opening direction of the movable valve element and being delimited by said maximum opening cross section; and a ratio of said first control face (31) to that of said second working face (32) is equal to or smaller than a ratio of said second working face (32) to said functional face (43) of said movable valve element.

2. A hydraulic control as defined by claim 1, which includes at least one high-pressure control line (28) branching off from said pump piston work chamber (4) and which discharges into said control chamber (40), wherein a deflecting motion of said control piston (29) is predeterminable by an opening time cross section of functional face (43) said control valve (33).

3. A fuel injection pump as defined by claim 1, in which said control valve is a magnetic valve (33).

4. A fuel injection pump as defined by claim 2, in which said control valve is a magnetic valve (33).

5. A fuel injection pump piston as defined by claim 1, in which said stepped piston (29) is urged in a direction of the pump work chamber (4) by a spring (34).

6. A fuel injection pump piston as defined by claim 2, in which said stepped piston (29) is urged in a direction of the pump work chamber (4) by a spring (34).

7. A fuel injection pump piston as defined by claim 3, in which said stepped piston (29) is urged in a direction of the pump work chamber (4) by a spring (34).

8. A fuel injection pump as defined by claim 1, in which said stepped piston (29) controls fluid flow via said relief conduit (38).

9. A fuel injection pump as defined by claim 2, in which said stepped piston (29) controls fluid flow via said relief conduit (38).

10. A fuel injection pump as defined by claim 4, in which said stepped piston (29) controls fluid flow via said relief conduit (38).

11. A fuel injection pump as defined by claim 3, in which said stepped piston (29) controls fluid flow via said relief conduit (38).

12. A fuel injection pump as defined by claim 5, in which said stepped piston (29) controls fluid flow via said relief conduit (38).

13. A fuel injection pump as defined by claim 1, in which said stepped piston (29') with its larger diameter and said stepped bore forms a reservoir toward said pump piston work chamber (4).

14. A fuel injection pump as defined by claim 2, in which said stepped piston (29') with its larger diameter and said stepped bore forms a reservoir toward said pump piston work chamber (4).

15. A fuel injection pump as defined by claim 4, in which said stepped piston (29') with its larger diameter and said stepped bore forms a reservoir toward said work chamber (4).

16. A fuel injection pump as defined by claim 3, in which said stepped piston (29') with its larger diameter and said stepped bore forms a reservoir toward said work chamber (4).

17. A fuel injection pump as defined by claim 5, in which said stepped piston (29') with its larger diameter and said stepped bore forms a reservoir toward said pump piston work chamber (4).

* * * * *